US007578223B2

(12) United States Patent
Bliss

(10) Patent No.: US 7,578,223 B2
(45) Date of Patent: Aug. 25, 2009

(54) MODULAR DIE PRESS ASSEMBLY

(75) Inventor: Joseph Bliss, Macomb, MI (US)

(73) Assignee: Superior Cam, Inc., Madison Heights, MI (US)

( * ) Notice: Subject to any disclaimer, the term of this patent is extended or adjusted under 35 U.S.C. 154(b) by 823 days.

(21) Appl. No.: 10/797,448

(22) Filed: Mar. 10, 2004

(65) Prior Publication Data

US 2004/0231398 A1 Nov. 25, 2004

Related U.S. Application Data

(60) Provisional application No. 60/453,475, filed on Mar. 10, 2003.

(51) Int. Cl.
*B26D 5/08* (2006.01)

(52) U.S. Cl. ..... 83/532; 83/698.71; 72/446; 72/448

(58) Field of Classification Search ..... 83/13, 83/531, 532, 698.71; 72/448, 449, 446, 453.13, 72/453.03, 462
See application file for complete search history.

(56) References Cited

U.S. PATENT DOCUMENTS

| | | | | | |
|---|---|---|---|---|---|
| 2,237,449 | A | * | 4/1941 | Ryan | 83/531 |
| 3,949,589 | A | * | 4/1976 | Johnson et al. | 72/413 |
| 4,014,232 | A | * | 3/1977 | Mauger | 83/144 |
| 4,096,729 | A | * | 6/1978 | Dupler | 72/350 |
| 4,143,574 | A | * | 3/1979 | Ryser et al. | 83/698.71 |
| 4,151,736 | A | | 5/1979 | Quaas et al. | |
| 4,158,910 | A | * | 6/1979 | Hanas et al. | 29/469 |
| 4,160,372 | A | * | 7/1979 | Bergman et al. | 72/404 |
| 4,930,334 | A | | 6/1990 | Buehler et al. | |
| 5,000,022 | A | | 3/1991 | Shinkai et al. | |
| 5,146,774 | A | | 9/1992 | Smith | |
| 5,277,687 | A | | 1/1994 | Shimoichi et al. | |
| 5,600,991 | A | * | 2/1997 | Munzen | 72/348 |
| 6,000,322 | A | | 12/1999 | To | |
| 6,058,758 | A | | 5/2000 | Wymann | |
| 6,173,632 | B1 | * | 1/2001 | Choy | 83/13 |
| 6,276,185 | B1 | * | 8/2001 | Owens | 72/350 |
| 6,537,053 | B1 | * | 3/2003 | Watkins | 425/190 |
| 6,676,587 | B2 | * | 1/2004 | Smith et al. | 493/143 |
| 6,691,547 | B2 | * | 2/2004 | Cutshall et al. | 72/404 |
| 6,874,346 | B1 | * | 4/2005 | Faymonville | 72/389.4 |
| 7,004,007 | B2 | * | 2/2006 | Kruger et al. | 72/453.13 |
| 7,047,779 | B2 | * | 5/2006 | Kruger et al. | 72/57 |
| 7,210,323 | B2 | * | 5/2007 | Kruger et | 72/57 |
| 7,316,150 | B1 | * | 1/2008 | Genereux et al. | 72/452.8 |
| 7,363,790 | B2 | * | 4/2008 | Kruger et al. | 72/57 |

* cited by examiner

*Primary Examiner*—Boyer D Ashley
*Assistant Examiner*—Omar Flores-Saánchez
(74) *Attorney, Agent, or Firm*—Warn Partners, P.C.

(57) ABSTRACT

A die adaptor system includes a lower adaptor including a first press adaptor plate and a lower binder plate. The lower forming plate has a raised upwardly facing contact surface that is encircled by the lower binder plate. The die adaptor system also includes an upper adaptor having an upper forming plate and an upper binder plate. The upper forming plate has a raised downwardly facing contact surface that is encircled by the upper binder plate. A tool package is formed when the upper and lower adaptors are abuttingly engaged along the downwardly and upwardly facing contact surfaces. The tool package can be removed from the press and a new or different tool package can be inserted. A rack and pinion lift mechanism is integrated below the lower adaptor, to allow the tool package to be raised to a height high enough for removal from the press machine.

11 Claims, 10 Drawing Sheets

MODULAR DIE PRESS ASSEMBLY

CROSS-REFERENCE TO RELATED APPLICATIONS

This application claims the benefit of U.S. Provisional Application No. 60/453,475, filed Mar. 10, 2003.

FIELD OF THE INVENTION

The present invention relates to a press machine with interchangeable adaptor plates for quickly retooling the press machine.

BACKGROUND OF THE INVENTION

In the field of tool and die, press machines are used to press metal blanks (sheets of metal with a precut general shape) into three-dimensional shaped panels that vary in length, width and depth. Vehicle body panels, such as fenders, door casings, spare tire wheel wells engine hoods, etc., are typically formed by die press machines. With such a diverse number of shaped panels that are formed using a press machine, it is apparent that the press machines which create the panels will also be as equally diverse.

The press machines that are used to form the shaped panels vary in form and function. For instance, there are various types of press machines, such as, but not limited to, draw presses, punch presses, trim presses, cam presses and flange presses. While each of these press machines have various features that make them unique from one another, all of them have a similar general principle in that they form, cut or shape metal by pressing it between a pair of die shoes. The die shoes include an upper shoe and a lower shoe having opposing forming surfaces that are used to press the metal blanks into a shaped panel.

The die shoes will wear out after a certain number of presses and will need to be replaced. The replacement of a die shoe set is a very costly process because the die sets and related components are not reused. This translates into tens of thousands of dollars in cost overhead. Also, when a new die set is first introduced into a press it has to be aligned manually so that the contact between the upper and lower die shoes is proper. This aligning process requires a great deal of time and money because it is a very labor intensive operation.

SUMMARY OF THE INVENTION

The invention is directed to a die adaptor system for use in a die press machine. The die adaptor system includes a lower adaptor having a lower forming plate and a lower binder plate. The lower forming plate has a raised upwardly facing contact surface that is encircled by the lower binder plate. The die adaptor system also includes an upper adaptor having an upper forming plate and an upper binder plate. The upper forming plate has a raised downwardly facing surface that is encircled by the upper binder plate.

A tool package is formed when the upper and lower adaptors are abuttingly engaged along the downwardly and upwardly facing contact surfaces. The tool package can be removed from the press and a new or different tool package can be inserted.

The die adaptor system also includes a lower shoe detail that has a lower die shoe that forms a base of the lower shoe detail. The lower shoe detail has an upper surface configured to receive a punch adaptor that rests on the surface of the lower die shoe and extends upward from the lower surface of the lower die shoe. A binder holder rests on the edges of the lower die shoe and extends across the lower die shoe. The binder holder has an aperture that is generally located centrally on the binder holder and circumscribes the upper portion of the punch adaptor. The aperture of the binder holder is configured to receive and hold the lower adaptor of the tool package.

The die adaptor system further includes an upper shoe detail that has an upper die shoe that forms a base of the upper shoe detail. The upper shoe detail has a downwardly facing surface that is configured to receive a binder holder. The binder holder has a centrally located aperture for receiving and holding the upper adaptor of the tool package.

Further areas of applicability of the present invention will become apparent from the detailed description provided hereinafter. It should be understood that the detailed description and specific examples, while indicating the embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EMBODIMENTS

The following description of the embodiment(s) of the invention is merely exemplary in nature and is in no way intended to limit the invention, its application, or uses.

Figure 1:
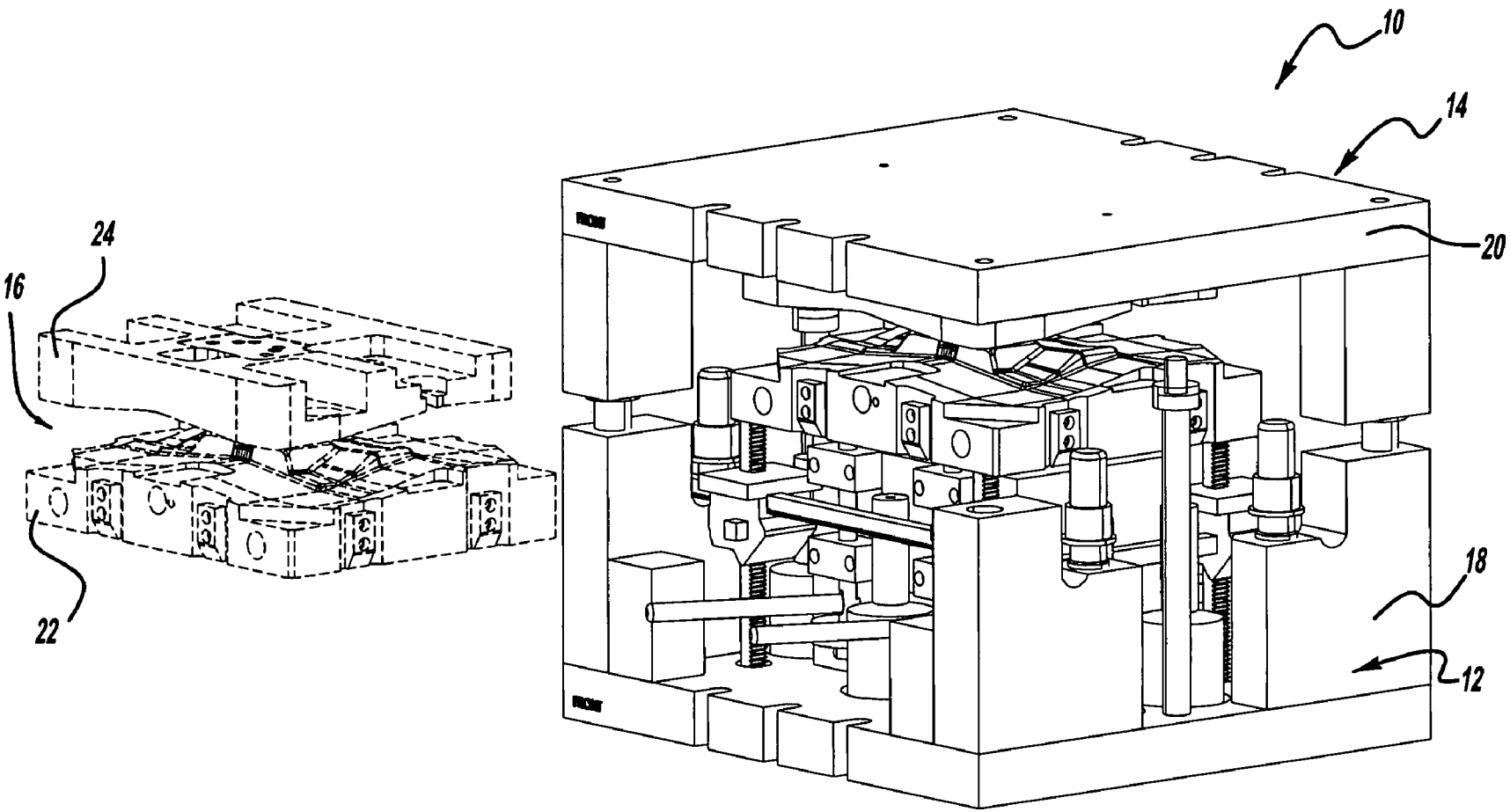
FIG. 1 is a perspective view of a die press mechanism with conventional hydraulics that raise and lower the lower and upper die shoes hidden from view.

FIG. 1 illustrates a perspective view of a die press mechanism 10 generally shown in this embodiment as a draw press. This particular view of the press mechanism 10 is with the upper and lower binder holders removed to allow an interchangeable tool package 16 to be more clearly seen. It should be understood that a person skilled in the art would realize that this invention can be used with other types of press mechanisms such as, but certainly not limited to, punch presses, trim presses, cam presses, flange presses, or any type of press mechanism that may benefit from the use of an interchangeable die adaptor system.

The press mechanism 10 includes a lower shoe detail 12, an upper shoe detail 14, and the interchangeable tool package 16. The lower shoe detail 12 has a lower die shoe 18 that forms the lower boundary of the press mechanism 10. The upper shoe detail 14 has an upper die shoe 20 that forms the upper boundary of the press mechanism 10. When the press mechanism 10 is incorporated in a press machine (not shown) there is one or more lift mechanisms (not shown) that contact the lower and upper die shoes 18, 20 to facilitate movement of the lower and upper shoe details 12, 14 relative to one another. Such lift mechanisms are typically hydraulic, however, any mechanical means of moving the upper and lower shoe details 12, 14 relative to one another is within the scope of this invention.

The tool package 16 includes a lower adaptor 22 (also referred to as a lower adaptor plate) and an upper adaptor 24 (also referred to as an upper adaptor plate). The lower and upper adaptors 22, 24 include forming surfaces which contact metal blanks (not shown) to form the molded panel end product. If the lower and upper adaptors 22, 24 become worn out, or if a different part is pressed using the press mechanism 10, the lower and upper adaptors 22, 24 can be connected together to form the tool package 16. As will be described later in greater detail, the tool package 16 can be removed from the press mechanism 10 and a new or different tool package can be inserted into the press mechanism 10.

Figure 2:
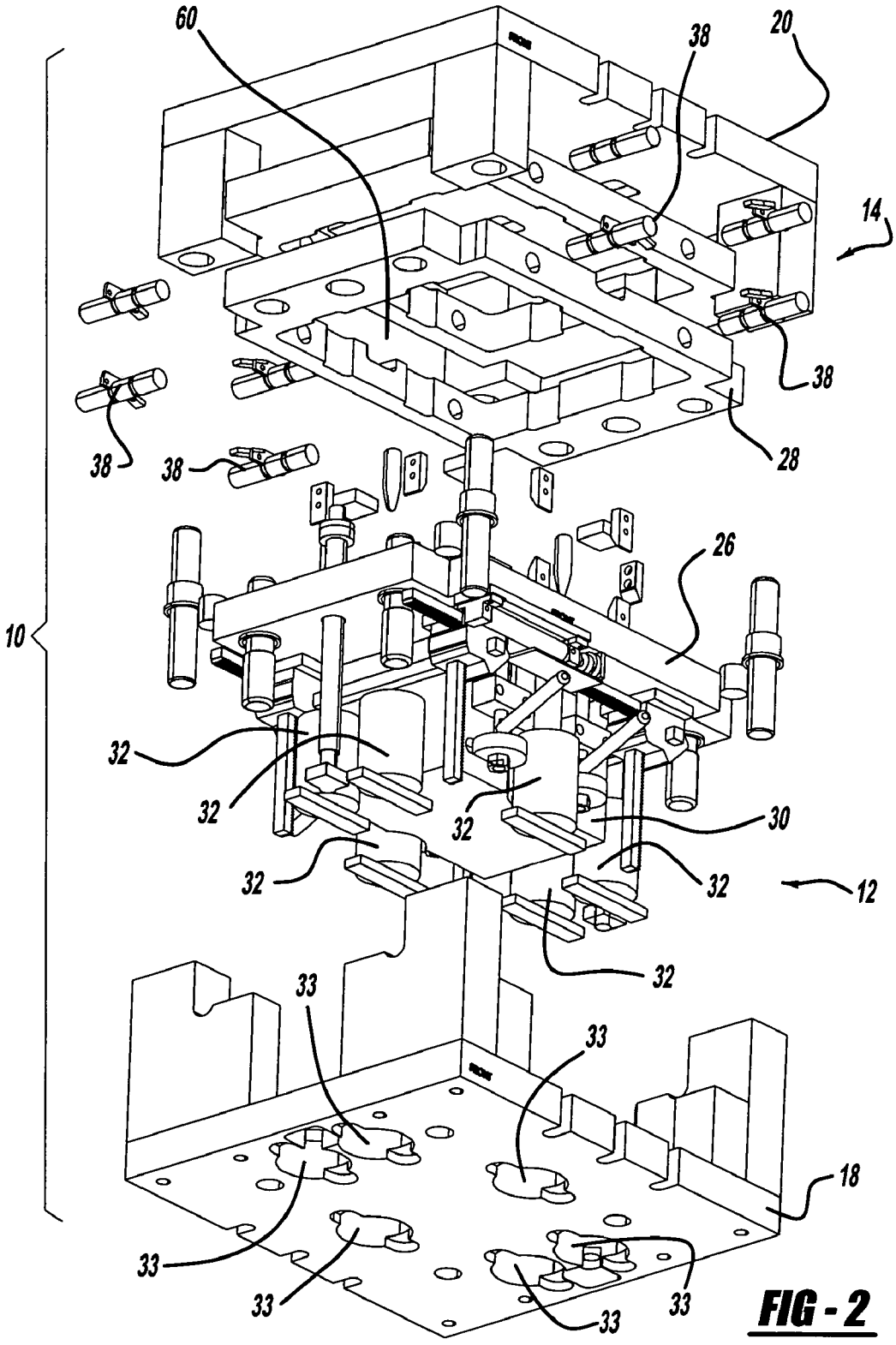
FIG. 2 is an exploded angled perspective view of the die press mechanism.

FIG. 2 is an exploded perspective view of the press mechanism 10. The lower shoe detail 12 includes a punch adaptor 30 which rests on the lower die shoe 18. One or more nitro-cylinders 32 are dispersed along the surface of the lower die shoe 18 and are located near the punch adaptor 30. The nitro-cylinders 32 provide greater binder holding pressure for the lower shoe detail 12 so that the upper and lower adaptors 22, 24 can more firmly grip the metal blank. The nitro-cylinders 32 align with holes 33 on the bottom surface of the lower die shoe 18. The lower shoe detail 12 has a lower binder holder 26 located at the top of the punch adaptor 30. The lower binder holder 26 is configured to contain the lower adaptor 22.

The upper shoe detail 14 includes the upper binder holder 28 that is connected to the upper die shoe 20. The upper binder holder 28 may be welded to the upper die shoe 20. It is also possible to use fasteners to connect the upper binder holder 28 to the upper die shoe 20 for use in embodiments where it is desirable to interchange the upper binder holder 28. The upper binder holder 28 has a centrally located aperture 60 that forms a seat for receiving and attaching the upper adaptor 24. The upper adaptor 24 is attached to the upper binder holder 28 using keeper pins 38. This particular embodiment shows the use of four keeper pins 38, however, a person skilled in the art would realize that a greater or lesser number of the keeper pins 38 can be implemented depending on variables such as the size of the upper adaptor 24 and the size of the keeper pins 38.

Figure 3:
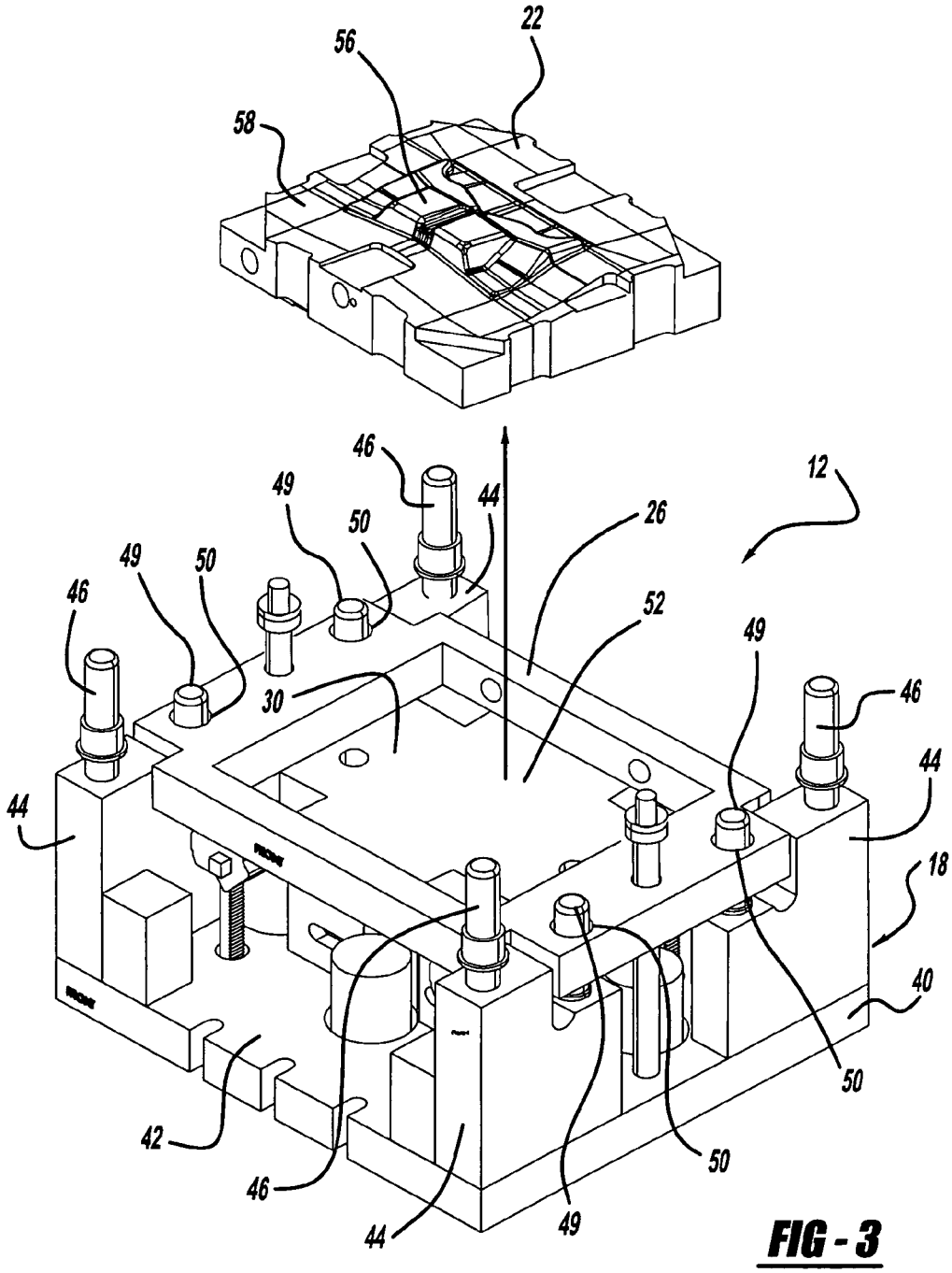
FIG. 3 is a perspective view of the lower shoe detail with the upper shoe detail and nitro-cylinders removed.
Figure 4:
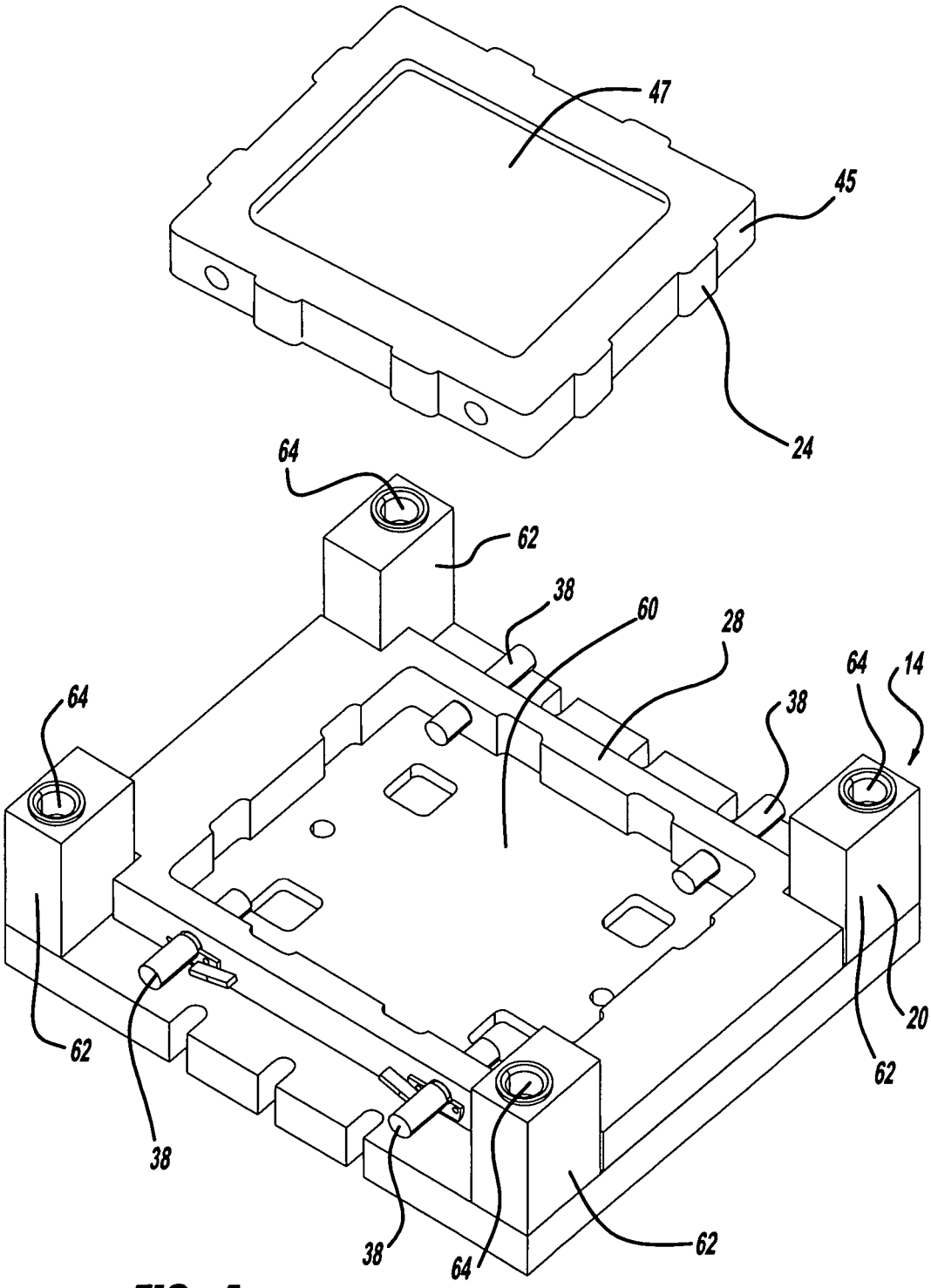
FIG. 4 is a perspective view of the upper die shoe that is inverted so that the bottom surface can be seen.

FIG. 3 is a partially exploded perspective view of the lower shoe detail 12 with the lower adaptor 22 shown above the lower shoe detail 12. The lower shoe detail 12 includes the lower die shoe 18 that has a base plate 40 with an upper surface 42. Four raised columns 44 are provided at the four corners of the base plate 40. Each of the four columns 44 has a locator pin 46 that extends upward. During operation of the press mechanism 10, the locator pins 46 aid in the alignment of the lower and upper shoe details 12, 14. Referring briefly to FIG. 4, there can be seen four locator pin holes 64 formed on the upper die shoe 20 that are configured to receive the locator pins 46 when the press mechanism 10 is in correct alignment. The upper surface 42 of the base plate 40 is configured to receive and hold the punch adaptor 30 that is positioned on and extends upward from the upper surface 42 of the base plate 40.

The lower binder holder 26 extends across the lower die shoe 18 and is held to the lower die shoe 18 by four binder posts 49. The lower binder holder 26 has four binder post holes 50 that extend through the lower binder holder 26 and slide over the four binder posts 49. It should be understood that different embodiments of the invention may incorporate a greater or lesser number of binder posts 49 and the binder post holes 50 depending on the size of the binder holder 26 that is going to be used.

The lower binder holder 26 includes an aperture 52 that is generally located in the center portion of the binder holder 26. The aperture 52 is aligned with the top surface of the punch adaptor 30. The aperture 52 and the punch adaptor 30 form a seat for receiving the lower adaptor 22. The lower adaptor 22 includes a lower forming plate 56 that is circumscribed by a lower binder plate 58. The lower forming plate 56 is the portion of the lower adaptor 22 that contacts the metal blanks (not shown) to form the metal panel. The lower adaptor 22 is prefabricated to align with the aperture 52 of the lower binder holder 26 so that the lower adaptor 22 rests on the top surface of the punch adaptor 30 and is circumvented by the lower binder holder 26. The lower binder plate 58 functions to size the lower adaptor 22 so that it will fit into the aperture 52 of the lower binder holder 26. The dimensions of the lower binder plate 58 will vary depending of the dimensions of the lower forming plate 56 and the aperture 52 of the lower binder holder 26.

FIG. 4 illustrates a partially exploded perspective view of the upper shoe detail 14 with the upper adaptor 24 positioned above the upper shoe detail 14. The upper shoe detail 14 includes the upper die shoe 20 with the upper binder holder 28 having a centrally located aperture 60 for receiving and holding the upper adaptor 24. Once positioned in the aperture 60, the upper adaptor 24 will be held in place by the keeper pins 38. The upper adaptor 24 includes an upper binder plate 45 and an upper forming plate 47. The forming surface 47 is the portion of the upper adaptor 24 that contacts and forms the metal blank during a press operation. The binder 45 can vary in size depending on the size of the forming surface 47 so that the upper adaptor 24 will properly fit into the aperture 60.

The upper die shoe 20 has four upper columns 62 with the locator pin holes 64 configured to receive the locator pins 46 attached to the lower die shoe 12. The locator pins 46 and the locator pin holes 64 function to guide the lower shoe detail 12 and the upper shoe detail 14 into alignment so the lower adaptor 22 and the upper adaptor 24 contact properly.

Figure 5:
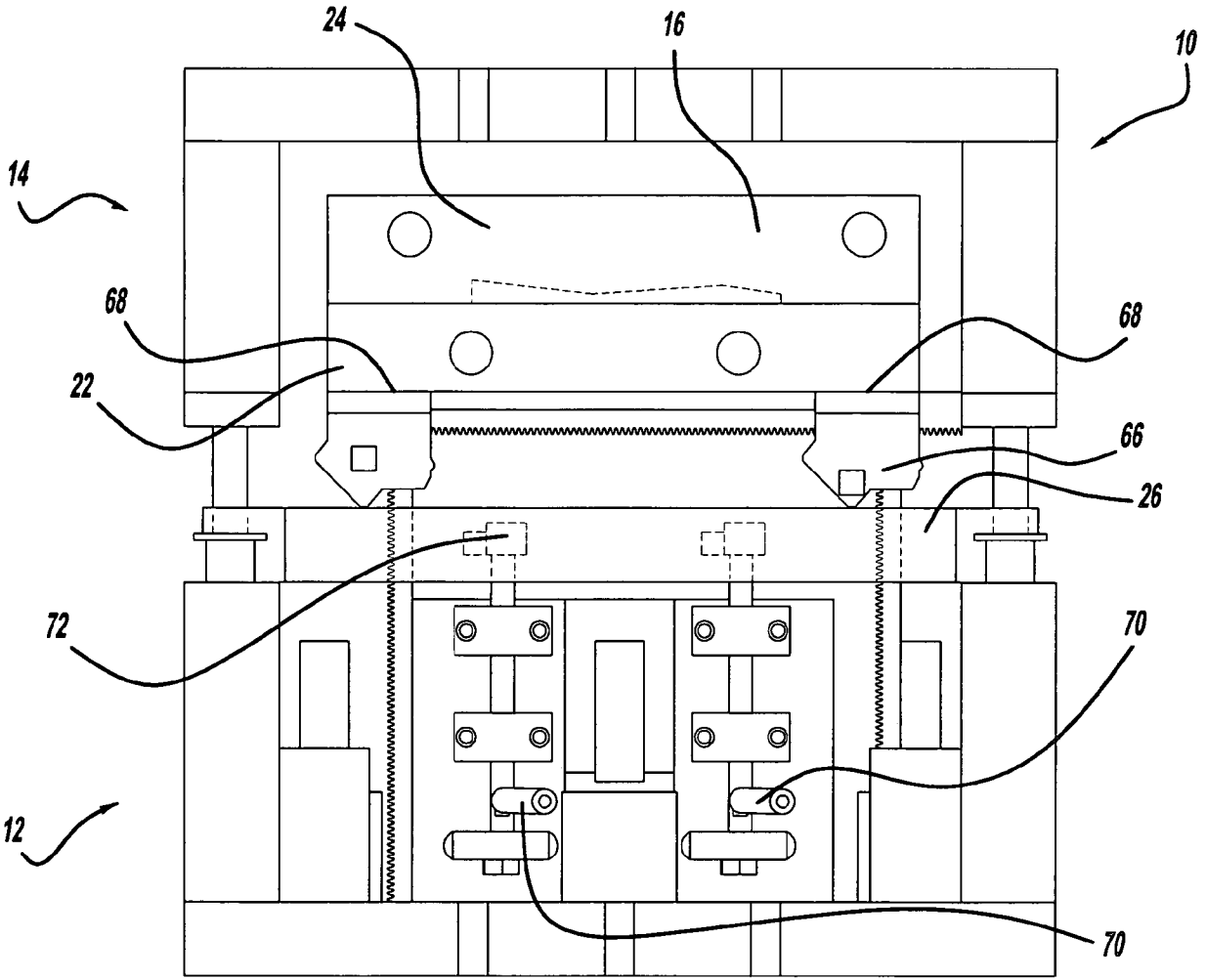
FIG. 5 is a side view of the press mechanism with the tool package lifted for removal.

FIG. 5 is a side view of the press mechanism 10. As shown, the tool package 16 including the upper adaptor 24 and the lower adaptor 22 is located between the upper shoe detail 14 and lower shoe detail 12. The tool package 16 can be lifted above the lower binder holder 26.

In order to facilitate the vertical lifting of the tool package 16, a rack and pinion lift mechanism 66 has been installed in the lower shoe detail 12. The rack and pinion lift mechanism 66 contacts a bottom surface 68 of the lower adaptor 22 to lift the tool package 16 above the lower binder holder 26. While this particular embodiment discloses the use of the rack and pinion lift mechanism 66, it should be understood that virtually any other type of lift mechanism could be incorporated. For instance, it would be possible to use a hydraulic or pneumatic lift mechanism. Furthermore, it is possible for the rack and pinion lift mechanism 66 to operate by contacting a surface other than the bottom surface 68 of the lower adaptor 22. For example, the lift mechanism 66 may operate by contacting a flange mounted to the side of the lower adaptor 22.

FIG. 5 also shows a pair of rotating latches 70 which have an end 72 (shown in phantom) disposed in the aperture 52 of the lower binder holder 26. The latches 70 can rotate and function to lock onto the bottom surface 68 of the lower adaptor 22 when the tool package 16 is lowered so that the lower adaptor 22 is in the aperture 52 of the lower binder holder 26.

One of the advantageous features of this invention is the interchangeability of the tool package 16, described in detail below. The tool package 16 is formed when the upper adaptor 24 is lowered toward the lower adaptor 22. The upper adaptor plate 24 is then disconnected from the upper binder holder 28 of the upper shoe detail 14. This is carried out by removing the keeper pins 38 from the upper binder holder 28. The upper adaptor 24 is then fastened to the lower adaptor 22 with fasteners that are inserted into overlapping wedges that are attaching to the sides of both the upper and lower adaptors 22, 24. The linking of the lower and upper adaptors 22, 24 forms the tool package 16. The upper shoe detail 14 is then moved vertically upward to completely separate the upper shoe detail 14 from the newly formed tool package 16. This also provides spatial clearance above the tool package 16 so that the tool package 16 can be raised up for removal. The lower adaptor 22 of the tool package 16 is disconnected from the lower shoe detail 12 by rotating the pair of latches 70 which lock onto the lower surface of the lower adaptor 22. Once the latches 70 are moved to the release position, the tool package 16 can be raised away from the lower shoe detail 12 using the rack and pinion lift mechanism 66. The tool package 16 is raised to a height sufficient enough to allow a forklift to slide under and remove the tool package 16 from the lift mechanism 66. While the use of a forklift is described, it should be understood that virtually any type of lift and removal mechanism can be incorporated. Once the tool package 16 is removed, a new one can be inserted by reversing the steps described above.

An alternate embodiment of the present invention involves incorporating the interchangeable tool package on a punch press. A punch press is characterized as a press that has forming surfaces configured to cut metal pieces out of the surface of a metal blank. The purpose of such a press is to provide a part having holes that can be used to mount objects, such as, but not limited to, wiring harnesses, switches, window handles etc. Many of the parts of the punch press embodiment are analogous to the parts in the previous embodiment. Where applicable, FIGS. 6–10 show the punch press embodiment with analogous parts having the same reference numerals as the previous embodiment differing by 100.

Figure 6:
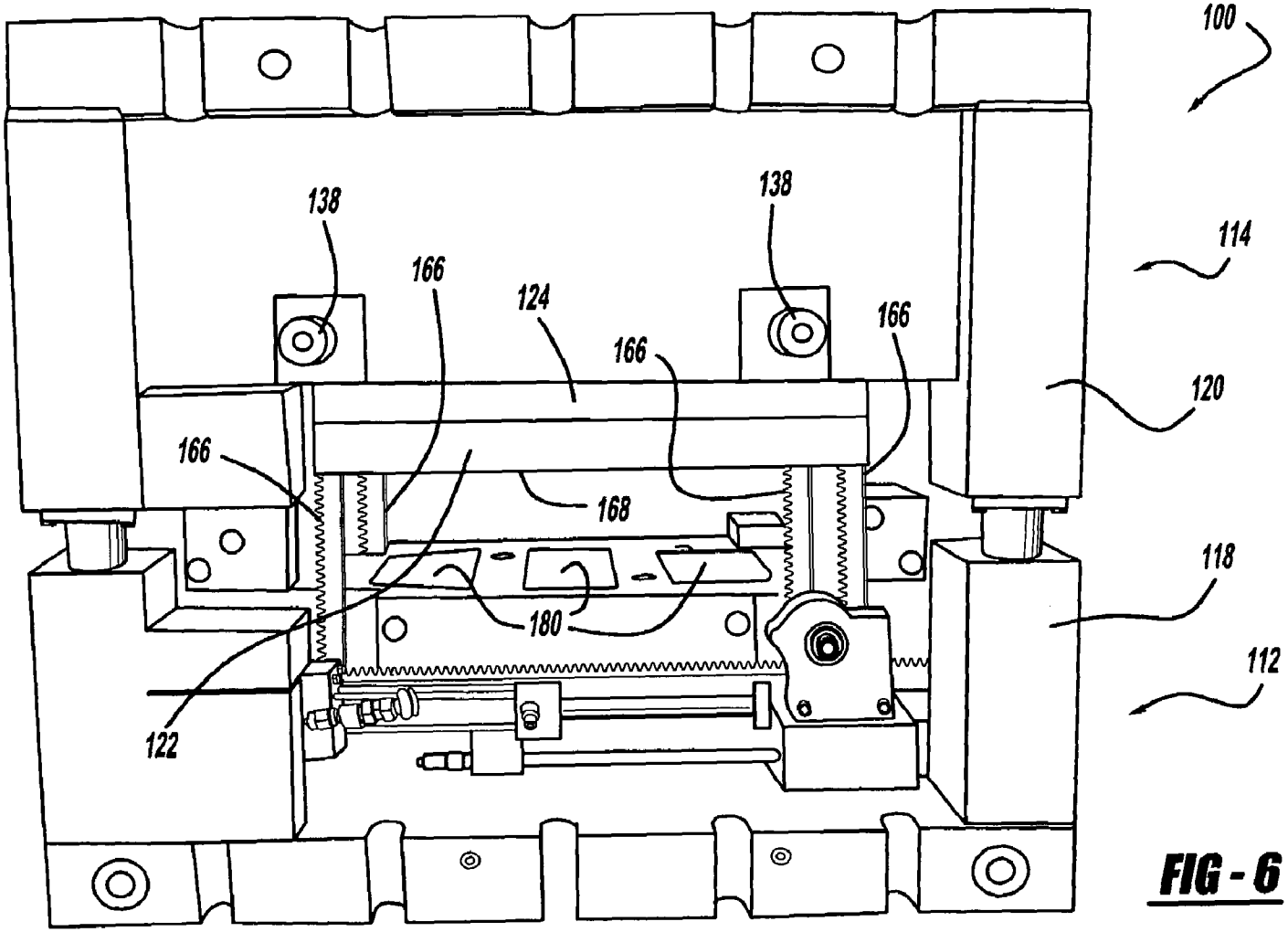
FIG. 6 is a perspective side view of the punch press embodiment.

FIG. 6 is a perspective side view of the punch press 100 having a lower shoe detail 112 and an upper shoe detail 114. A tool package 116 can be seen raised above the lower shoe detail 112 using a rack and pinion lift mechanism 166.

Figure 7:
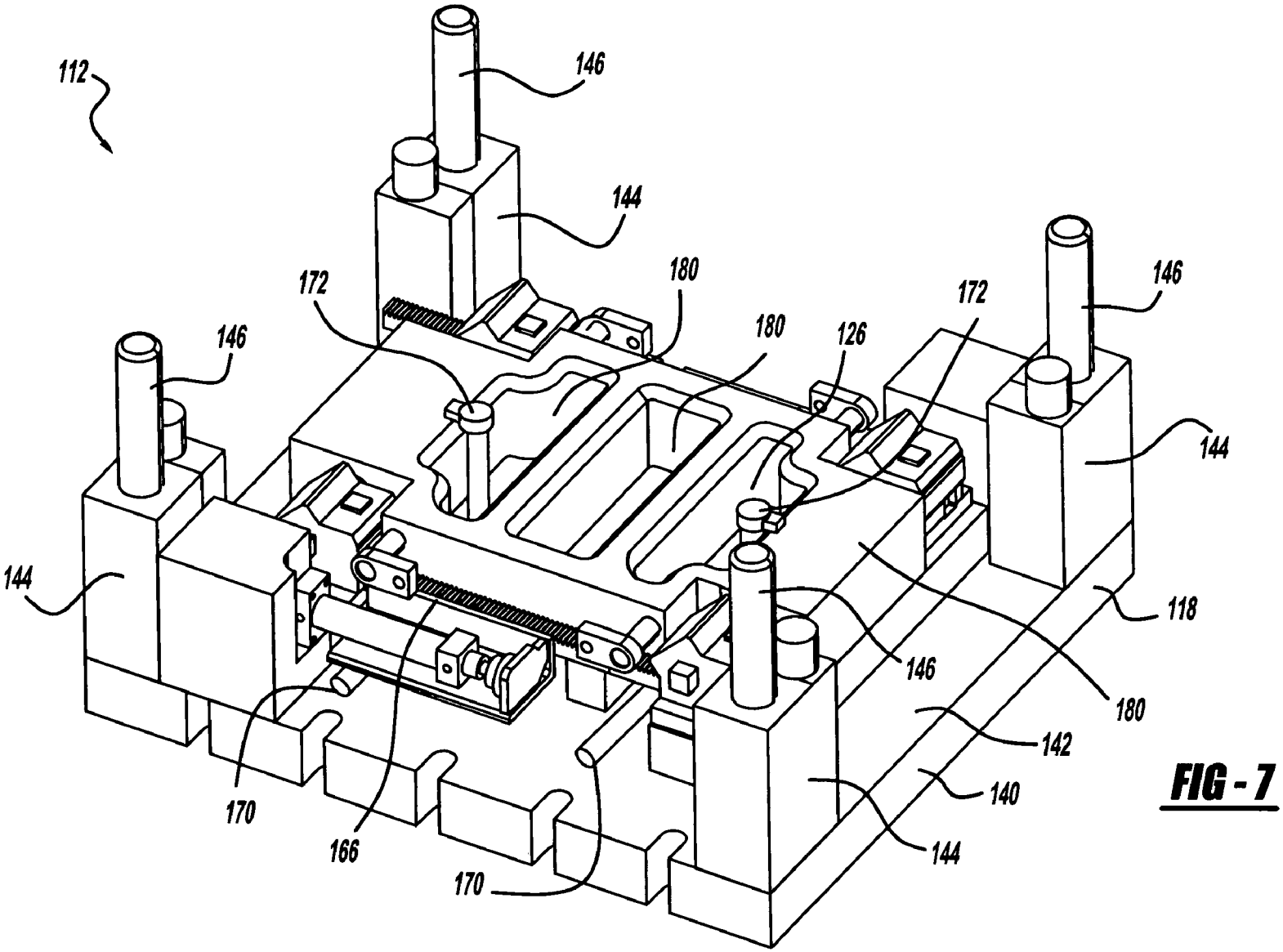
FIG. 7 is a perspective view of the lower shoe detail having the lower adaptor removed.
Figure 8:
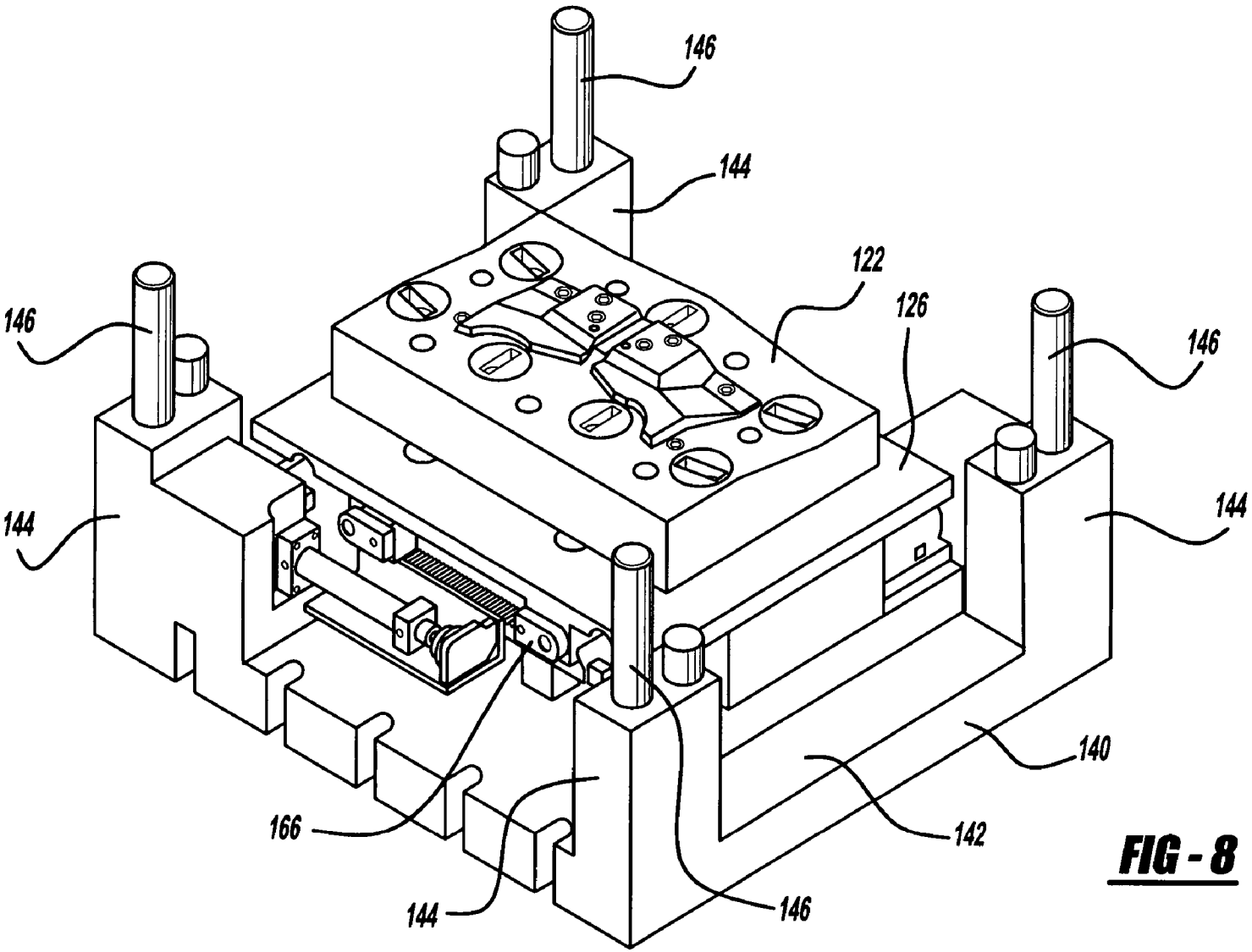
FIG. 8 is a perspective view of the lower shoe detail having the lower adaptor connected.

FIGS. 7–8 depict perspective views of the lower shoe detail 112. FIG. 7 shows the lower shoe detail 112 with the lower adaptor 122 removed, while FIG. 8 has the lower adaptor 122 shown. The lower shoe detail 112 includes a lower die shoe 118, the lift mechanism 166, a lower binder holder 126 and the lower adaptor 122. The lower die shoe 118 has a base plate 140 with an upper surface 142. The lift mechanism 166, is positioned on the upper surface 142 of the base plate 140. Four raised columns 144 are integrated with and extend upward form the upper surface 142 of the base plate 140. Each of the four raised columns 144 has a locator pin 146 that will be used to align the lower and upper shoe details 112, 114 during a pressing operation.

FIG. 7 shows a pair of rotating latches 170 which have an end 172 disposed in the chute 180 of the binder holder 126. The latches 170 can rotate and function to lock onto the bottom surface 168 of the lower adaptor 122 when the tool package 116 is lowered so that the lower adaptor 122 is held in place.

Figure 9:
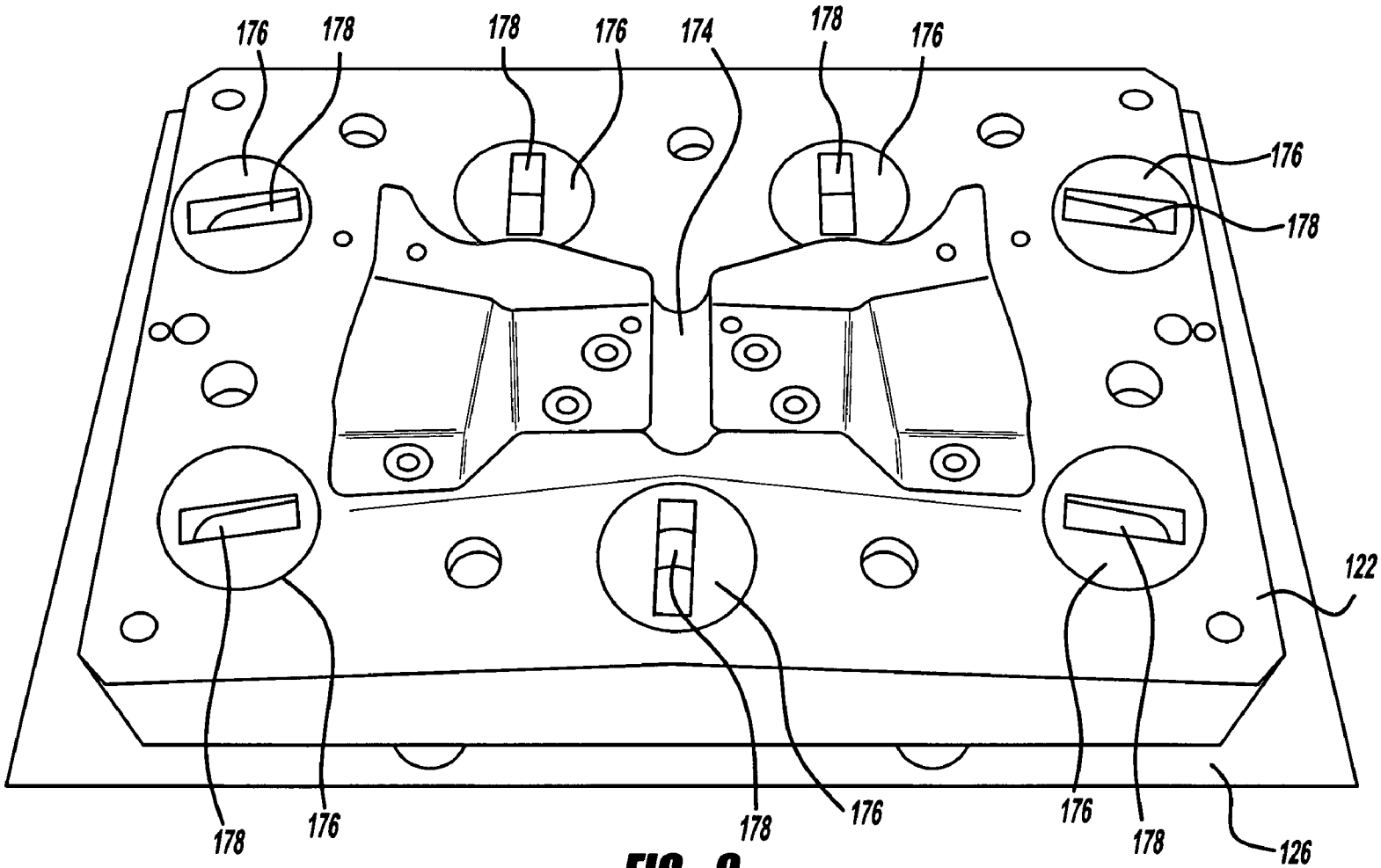
FIG. 9 is a close-up perspective view of the lower shoe detail.

FIG. 9 is a prospective view of the lower adaptor 122. The lower adaptor 122 has a forming surface 174 that will form the metal blank (not shown) during a press operation. There are also several punch cores 176 that are used to cut holes in specific areas of the metal blank. The punch cores 176 have holes 178 that allow the scrap metal (i.e., the metal pieces that are punched out of the blank) to fall through the lower adaptor 122. Under the lower adaptor 122 is the binder holder 126 which has three chutes 180 configured to align with and collect the scrap metal that is punched through the punch cores 176. The three chutes 180 all lead to a common collection pan that gathers the scrap metal for removal. This is a particular advantage because it increases productivity by elimination of the need to clear the punch press 100 of scrap metal between loading metal blanks.

Figure 10:
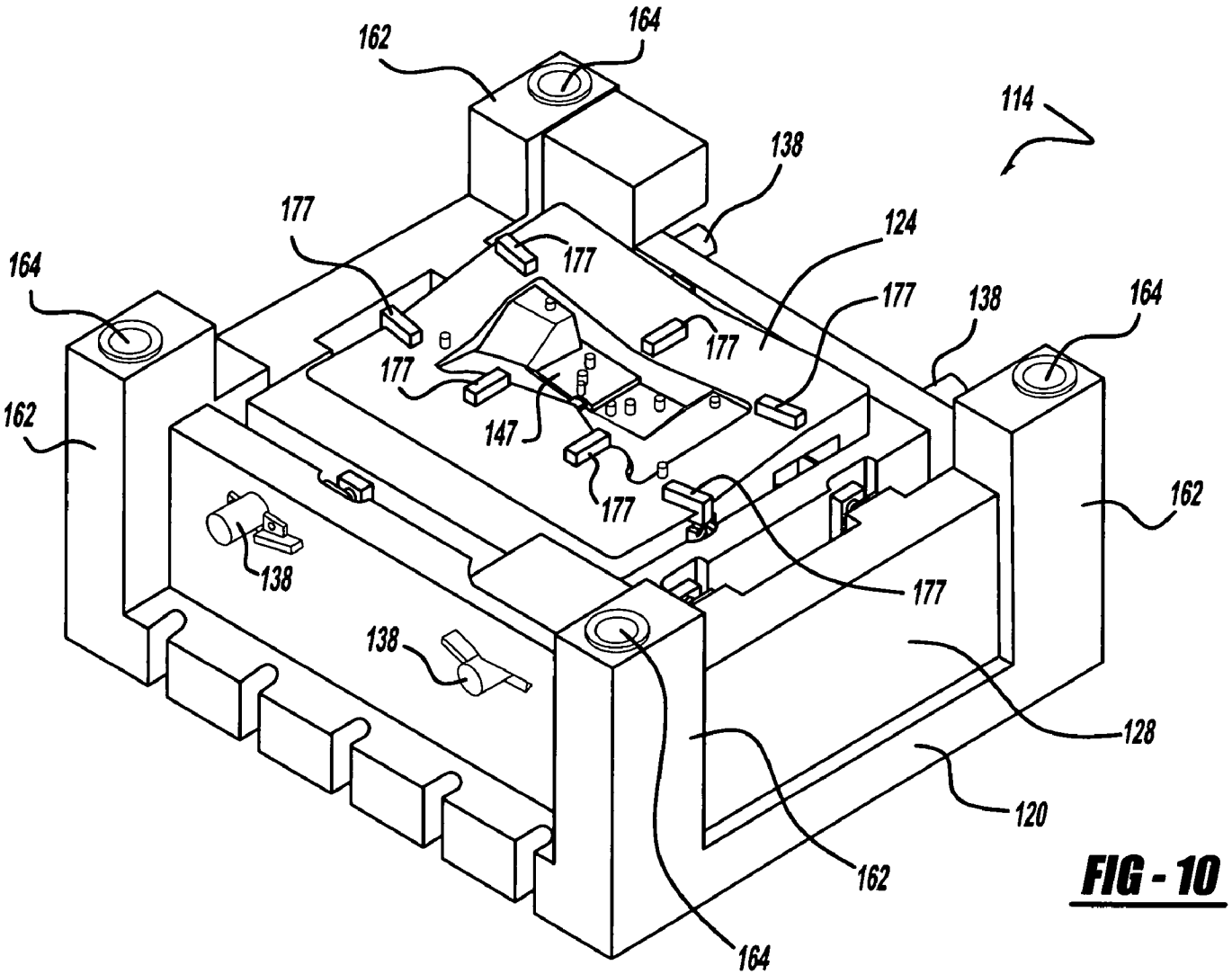
FIG. 10 is a perspective view of the upper shoe detail having the upper adaptor connected.

FIG. 10 illustrates a partially exploded perspective view of the upper shoe detail 114 with the upper adaptor 124 connected. The upper shoe detail 114 includes an upper die shoe 120 with an upper binder holder 128 that is configured for receiving and holding the upper adaptor 124. The upper adaptor 124 will be held in place using four keeper pins 138. Although this particular embodiment uses four keeper pins 138, it is possible to use a greater or lesser number of keeper pins 138 depending on such factors as size of the upper adaptor 124 or the type of press the invention is being used with. The upper adaptor 124 has a forming surface 147 and several punches 177. The punches 177 are configured to align with the punch cores 176 on the lower adaptor 122. The punches 177 work in conjunction with the punch cores 176 to punch holes in the metal blank (not shown) by cutting the metal so that the scrap metal falls through the holes 178 in the punch cores 176. The upper die shoe 120 also has four upper columns 162 with locator pin holes 164 configured to receive the locator pins 146 attached to the lower die shoe 112. The locator pins 146 and the locator pin holes 164 function to guide the lower shoe detail 112 and the upper shoe detail 114 into alignment so that the lower adaptor 122 and upper adaptor 124 contact properly. A proper alignment is particularly crucial in the punch press embodiment since the punches 177 must align perfectly with the holes 178 in order for holes to be cut in the metal blank.

In this embodiment the tool package 116 can be interchanged with another tool package (not shown) in the same manner described in the first embodiment above. Referring to FIGS. 6-10, the tool package 116 includes a lower adaptor 122 and an upper adaptor 124. The rack and pinion lift mechanism 166 contacts a bottom surface 168 of the lower adaptor 122 to lift the tool package 116 above the lower die shoe 118. One of the advantages of using the lift mechanism 166 is it allows for the interchangeability of the tool package 116. The tool package 116 is formed when the upper shoe detail 114 is lowered toward the lower shoe detail 112 so that the upper adaptor 124 comes in contact with the lower adaptor 122. The upper adaptor 124 is then disconnected from the upper shoe detail 114. This is carried out by removing the keeper pins 138 from the upper binder holder 128. The upper adaptor 124 is fastened to the lower adaptor 122, thus linking the lower and upper adaptors 122, 124 to form the tool package 116. The upper shoe detail 114 is then moved vertically upward to completely separate the upper shoe detail 114 from the newly formed tool package 116. This provides spatial clearance above the tool package 116 so that the tool package 116 can then be raised using the lift mechanism 166 for removal. The lower adaptor 122 is disconnected from the lower shoe detail 112 by rotating the pair of latches 170 which lock onto the lower surface of the lower adaptor 122. Once the latches are moved to the release position, the tool package 116 can be raised away from the lower shoe detail 112 using the rack and pinion lift mechanism 166. The tool package 116 is raised to a height sufficient enough to allow a forklift to remove the tool package 116 from the lift mechanism 166. While the use of a forklift is described, it should be understood that virtually any type of lift and removal mechanism can be incorporate. Once the tool package 116 is removed, a new one can be inserted by reversing the steps described above.

As discussed earlier, one particular problem in the field of tool and die is that the large dies that are used in conventional press machines wear out after a period of time. This costs time and money because a new die set will have to be implemented in the press. It can take several hours to realign the new die set. Additionally, it is also very costly from a material standpoint since the die set is very large and costly to create. The present invention reduces the total cost and time by implementing a system that allows the tool package 16 to be quickly interchanged with a new tool package without having to realign the upper and lower shoe details. Furthermore, the present invention is much more cost effective since the tool package only consists of the upper and lower forming surfaces and the binders. This means that far less material is being discarded since the tool package is only a fraction of the size of a conventional die set. Additionally, more money is saved since the nitro-cylinders will not have to be replaces when a new tool package is inserted.

The use of the interchangeable tool packages also allows for different parts with different dimensions to be pressed using the same machine. For example, a whole family of parts can be designed and run on the same press machine. This involves designing a family of tool packages, each having different forming surfaces to correspond to different parts. The only limitation is that the size of the part cannot exceed the spatial limits of the apertures of the lower and upper binder holders. It is possible to also interchange the binder holders with a different binder holder with a larger aperture if it is desirable to have a larger tool package. However, the size of the part will still be limited by the size of the lower and upper press details. Using this system will permit both large and small parts to be produced quickly and easily from a family of tool packages.

The description of the invention is merely exemplary in nature and, thus, variations that do not depart from the subject matter of the invention are intended to be within the scope of the invention. Such variations are not to be regarded as a departure from the spirit and scope of the invention.

What is claimed is:

1. A die adaptor system for use in a press machine comprising:

a lower adaptor including a lower forming plate and a lower binder plate, said lower forming plate including a raised upwardly facing contact surface, wherein said lower binder plate circumscribes said raised upwardly facing contact surface;

an upper adaptor including an upper forming plate including a raised downwardly facing contact surface;

a tool package formed by said upper adaptor and said lower adaptor, wherein said tool package can be interchanged with a different tool package;

a lower shoe detail including a lower die shoe forming a base of said lower shoe detail, wherein said lower die shoe has an upper surface configured to receive said lower adaptor as a part of said lower shoe detail, and said upper surface has a punch adaptor that rests on the upper surface of said lower die shoe and extends upward from said upper surface;

a lower binder holder that extends across a lower die shoe, wherein said lower binder holder includes an aperture that circumscribes said upper portion of said punch adaptor to form a recess for receiving said lower adaptor, wherein said lower binder plate functions to size the lower adaptor to fit within said aperture of said lower binder holder; and an upper shoe detail having an upper die shoe forming a base of said upper shoe detail, wherein said upper shoe detail has a lower surface configured to receive said upper adaptor as part of said upper shoe detail.

2. The die adaptor system of claim 1 wherein said tool package formed by said lower adaptor and said upper adaptor are abuttingly engaged along said downwardly facing contact surface and said upwardly facing contact surface.

3. The die adaptor system of claim 1 further comprising a pair of rotating latches which have an end disposed in said aperture of said lower binder holder.

4. The die adaptor system of claim 1 further comprising one or more nitro cylinders dispersed along said upper surface of said lower die shoe, wherein said nitro cylinders provide greater binder holding pressure.

5. The die adaptor system of claim 1 wherein said lower surface of said upper die shoe further comprises an upper binder holder, wherein said upper binder holder has a centrally located aperture for receiving said upper adaptor.

6. A die adaptor system for use in a press machine comprising:

a lower adaptor including a lower forming plate including a raised upwardly facing contact surface;

an upper adaptor including an upper forming plate including a raised downwardly facing contact surface;

a tool package formed by said upper adaptor and said lower adaptor, wherein said tool package can be interchanged with a different tool package;

a lower shoe detail including a lower die shoe forming a base of said lower shoe detail, wherein said lower die shoe has an upper surface configured to receive said lower adaptor as a part of said lower shoe detail; and an upper shoe detail having an upper die shoe forming a base of said upper shoe detail, wherein said upper shoe detail has a lower surface configured to receive said upper adaptor as part of said upper shoe detail, and said lower surface of said upper die shoe has an upper binder holder, wherein said upper binder holder has a centrally located aperture for receiving said upper adaptor, wherein said upper adaptor further comprises an upper binder plate that circumscribes said raised downwardly facing contact surface, wherein said upper binder plate functions to size said upper adaptor to fit within said aperture of said upper binder holder.

7. The die adaptor system of claim 5 further comprising one or more keeper pins connected to the upper binder holder, wherein said keeper pins are configured to fasten said upper adaptor to said upper binder holder.

8. A die adaptor system for use in a press machine comprising:

a lower adaptor including a lower forming plate including a raised upwardly facing contact surface;

an upper adaptor including an upper forming plate including a raised downwardly facing contact surface;

a tool package formed by said upper adaptor and said lower adaptor, wherein said tool package can be interchanged with a different tool package;

a lower shoe detail including a lower die shoe forming a base of said lower shoe detail, wherein said lower die shoe has an upper surface configured to receive said lower adaptor as a part of said lower shoe detail, and said upper surface has a punch adaptor that rests on the upper surface of said lower die shoe and extends upward from said upper surface;

a lower binder holder that extends across a lower die shoe, wherein said lower binder holder includes an aperture that circumscribes said upper portion of said punch adaptor to form a recess for receiving said lower adaptor, an upper shoe detail having an upper die shoe forming a base of said upper shoe detail, wherein said upper shoe detail has a lower surface configured to receive said upper adaptor as part of said upper shoe detail;

one or more locator pins attached to said upper surface of said lower die shoe and extending toward said upper die shoe; and one or more locator pin holes in said lower surface of said upper die shoe, wherein said one or more locator pin holes is configured to receive said one or more locator pins during a pressing operation.

9. The die adaptor system of claim 1 further comprising:

a first lower binder holder that rests against two or more raised edges of said lower die shoe and extends across said lower die shoe, wherein said first lower binder holder has an aperture;

a first upper binder holder, extending across said upper die shoe, wherein said first upper binder holder has an aperture;

a second lower binder holder that can be interchanged with said first lower binder holder, wherein said second lower binder holder has an aperture that is a different size or shape than said aperture of said first lower binder holder; and a second upper binder holder that is configured to be interchanged with said first upper binder holder, wherein said second upper binder holder has an aperture that is a different size or shape than said aperture of said first upper binder holder.

10. The die adaptor system of claim 1 wherein said tool package is a tool package for a punch press having a lower adaptor having a forming surface and one or more punch cores having holes there through, and an upper adaptor having a forming surface and one or more punches configured to align with said holes of said one or more punch cores.

11. The die adaptor system of claim 1 wherein said lower binder holder has one or more chutes that extend through said lower binder holder to a collection pan.

* * * * *